United States Patent [19]

Sayama

[11] Patent Number: 4,714,200

[45] Date of Patent: Dec. 22, 1987

[54] NOZZLE FOR SPRAYER

[75] Inventor: Shigeharu Sayama, Fukuoka, Japan

[73] Assignee: Kyushu Hitachi Maxell, Ltd., Fukuoka, Japan

[21] Appl. No.: 916,364

[22] Filed: Oct. 7, 1986

Related U.S. Application Data

[63] Continuation of Ser. No. 700,288, Feb. 11, 1985, abandoned.

[30] Foreign Application Priority Data

Feb. 21, 1984 [JP] Japan ..... 59-23483[U]
Jan. 9, 1985 [JP] Japan ..... 60-1190[U]

[51] Int. Cl.[4] ..... B05B 1/30

[52] U.S. Cl. ..... 239/579; 239/581.2; 239/590.5; 251/344; 251/345; 251/900

[58] Field of Search ..... 239/436–441, 239/443, 444, 446–449, 499, 520, 554, 569, 579, 581.2, 590.5; 251/343–345, 900; 137/625.37

[56] References Cited

U.S. PATENT DOCUMENTS

| | | | |
|---|---|---|---|
| 2,044,694 | 6/1936 | Huss | 239/493 |
| 2,333,767 | 11/1943 | Davis | 239/449 |
| 3,058,670 | 10/1962 | Marotto et al. | 239/458 X |
| 3,111,273 | 11/1963 | Mei | 239/581 X |
| 3,189,284 | 6/1965 | Downey | 239/460 |
| 3,502,270 | 3/1970 | Prencipe | 239/458 |
| 3,514,042 | 5/1970 | Freed | 239/448 X |
| 3,982,698 | 9/1976 | Anderson | 239/436 X |
| 4,221,337 | 9/1980 | Shames et al. | 239/447 X |
| 4,265,405 | 5/1981 | Takagi | 239/440 |
| 4,366,368 | 12/1982 | Stephens, III | 239/446 X |
| 4,418,924 | 12/1983 | Mack | 251/900 X |
| 4,618,100 | 10/1986 | White et al. | 239/441 X |

*Primary Examiner*—Andres Kashnikow
*Assistant Examiner*—Mary Beth O. Jones
*Attorney, Agent, or Firm*—Birch, Stewart, Kolasch & Birch

[57] ABSTRACT

A nozzle for a sprayer having a spray body, including a nozzle body formed with a delivery hole communicating with the spray body, a sealing member fitted around the nozzle body axially rearwardly of the delivery hole, and a cap member axially retractably mounted on the nozzle body and formed, at its front face and at its outer periphery, with a spray opening and a discharge opening, respectively. A cover member with a central outlet hole is mounted on the cap member.

7 Claims, 17 Drawing Figures

Fig. 4
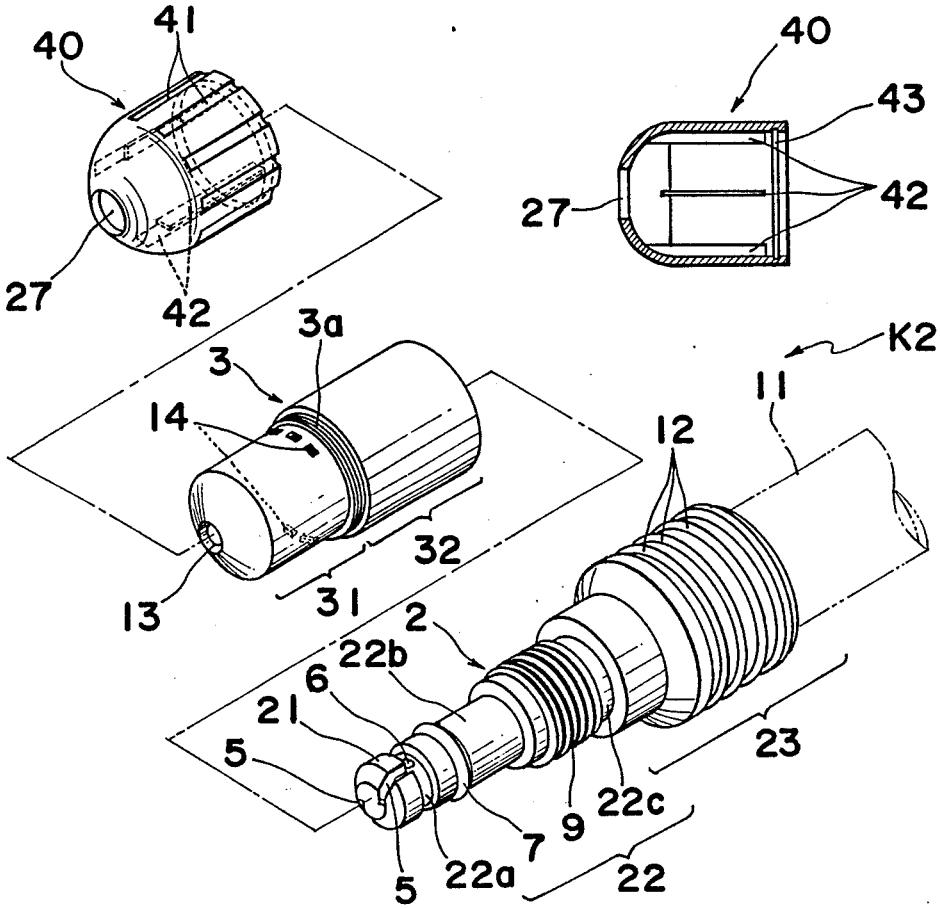
Fig. 5
Fig. 7a
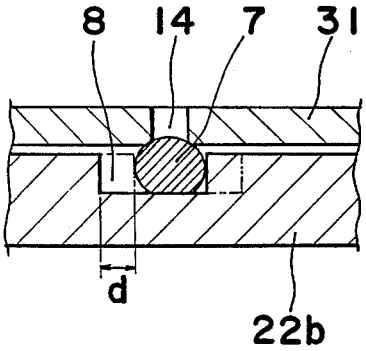
Fig. 7b
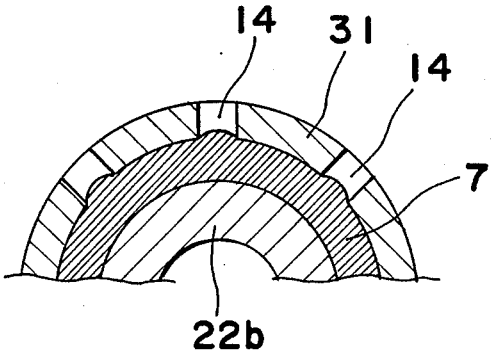

NOZZLE FOR SPRAYER

This application is a continuation of application Ser. No. 700,288, filed on Feb. 11, 1985, now abandoned.

BACKGROUND OF THE INVENTION

The present invention generally relates to nozzles for sprayers and more particularly, to a nozzle for a sprayer including a supply tank containing chemical liquid, in which a cap member formed with a spray opening and a plurality of discharge openings is axially retractably mounted on a nozzle body such that the nozzle can be changed over, by moving the cap member relative to the nozzle body axially, rearwardly and forwardly, to a spray mode for spraying the chemical liquid from the spray opening and a shower mode for showering the chemcial liquid from the discharge openings, respectively.

Conventionally, a sprayer used for gardening, etc. is generally composed of a supply tank containing chemical liquid and a spray body. In the known sprayer, the chemical liquid in the supply tank is sucked up by a pump provided in the spray body so as to be fed to a nozzle such that the chemical liquid is spread over trees or flowers from the nozzle. It is generally desirable for the chemical liquids to be discharged according to mode of use corresponding to the objects which the chemical liquids are to be used on. For example, in the case where a disinfectant is used as the chemical liquid, it is desirable for the disinfectant to be sprayed so as to be widely spread over the trees or the flowers. Meanwhile, in the case where nutritive liquid or water is poured on the soil, it is desirable that the nutritive liquid or the water not to be sprayed, but showered only on a necessary restricted area of the soil.

SUMMARY OF THE INVENTION

Accordingly, an essential object of the present invention is to provide an improved nozzle for a sprayer including a supply tank containing chemical liquid, which can be easily connected from a spray mode for spraying the chemical liquid to a shower mode for showering the chemical liquid.

Another important object of the present invention is to provide an improved nozzle of the above described type which is simple in structure and highly reliable in actual use.

In accomplishing these objects according to one preferred embodiment of the present invention, there is provided an improved nozzle for a sprayer including a spray body, the nozzle including: a nozzle body which is communicated with the spray body of the sprayer and a cap member formed with a spray opening and a plurality of discharge openings, which is axially retractably mounted on the nozzle body.

In accordance with the present invention, when the cap member is moved axially rearward and forward relative to the nozzle body, it becomes easy to change over the nozzle from the spray mode for spraying the chemical liquid from the spray opening to the shower mode for showering the chemical liquid from the discharge openings, respectively.

BRIEF DESCRIPTION OF THE DRAWINGS

These and other objects and features of the present invention will become apparent from the following description taken in conjunction with the preferred embodiments thereof with reference to the accompanying drawings, in which:

FIG. 4 is a view similar to FIG. 1, particularly showing a nozzle according to a second embodiment of the present invention;

FIG. 5 is a longitudinal sectional view of a cover employed in the nozzle of FIG. 4;

FIGS. 7*a* and 7*b* are a fragmentary longitudinal sectional view and a fragmentary cross-sectional view of the nozzle of FIG. 4, respectively, showing the nozzle in the spray mode;

Before the description of the present invention proceeds, it is to be noted that like parts are designated by like reference numerals throughout the several views of the accompanying drawings.

DETAILED DESCRIPTION OF THE INVENTION

Figure 1:
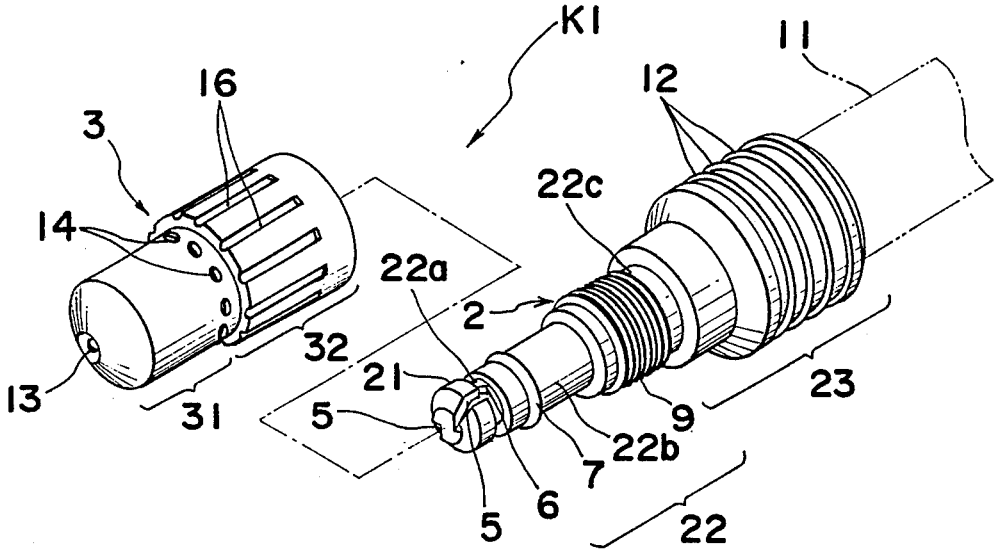
FIG. 1 is an exploded perspective view of a nozzle according to a first embodiment of the present invention.
Figure 2A:
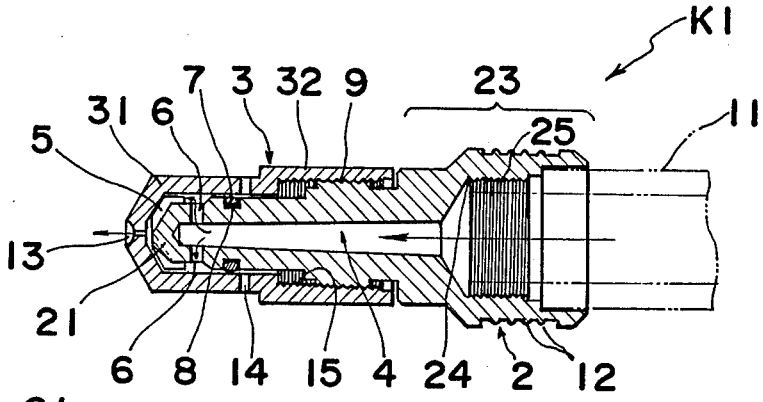
FIGS. 2*a* and 2*b* are longitudinal sectional views of the nozzle of FIG. 1, showing the nozzle in a spray mode and a shower mode, respectively.
Figure 2B:
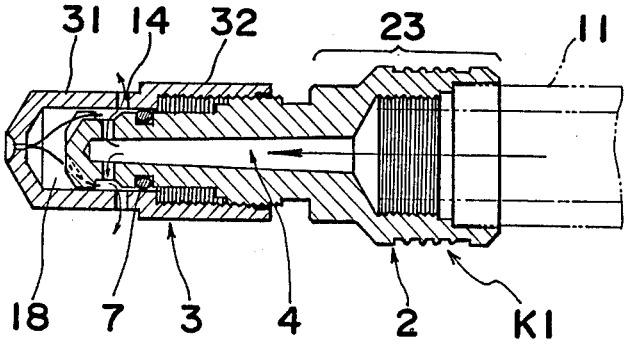
Figure 3A:
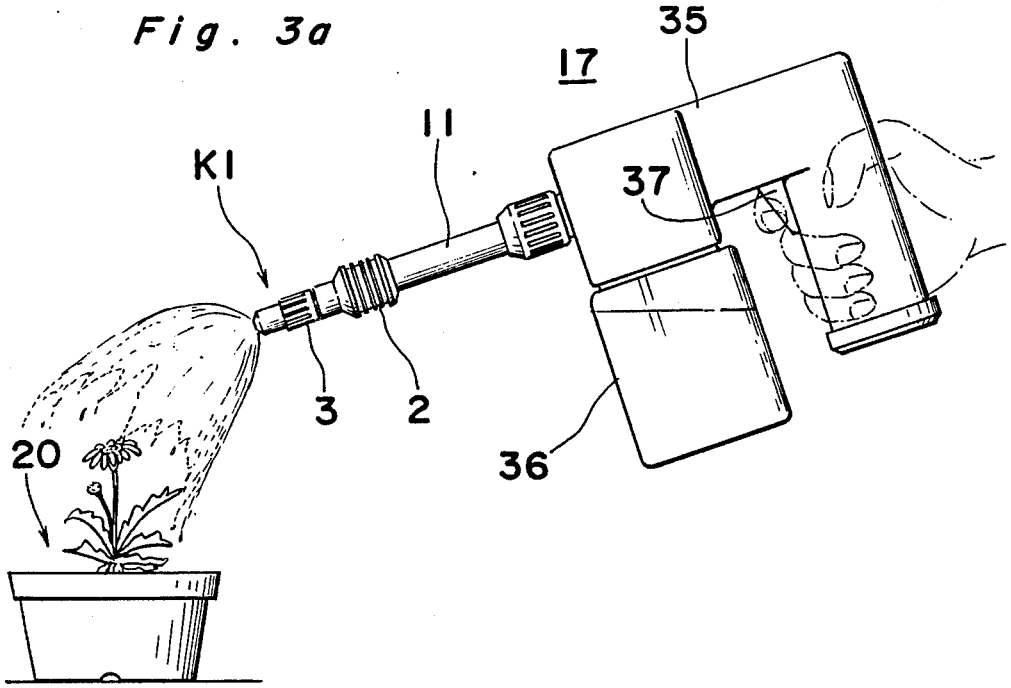
FIGS. 3*a* and 3*b* are side elevational views of the nozzle of FIG. 1, showing operations of the nozzle in the spray mode and the shower mode, respectively.
Figure 3B:
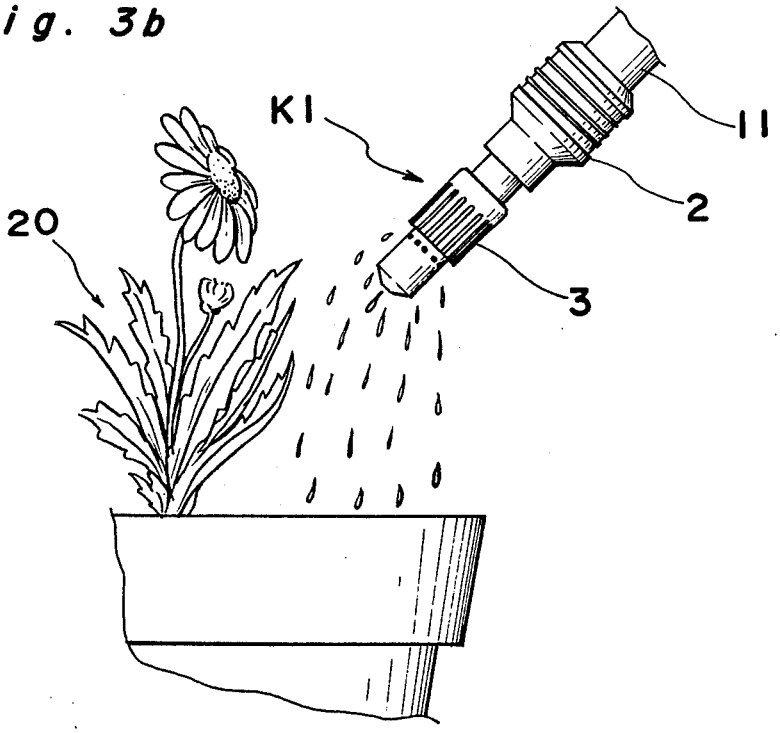

Referring now to the drawings, there is shown in FIGS. 1 to 3, a nozzle K1 for a sprayer 17, according to a first embodiment of the present invention. The nozzle K1 generally includes a nozzle body 2 and a cap member 3 axially retractably mounted on the nozzle body 2. The nozzle body 2 is constituted by a disklike front end portion 21, a body portion 22 and a connector portion 23 which are axially arranged rearwardly in this order so as to be connected with each other. The nozzle body 2 further has a flow path 4 extending axially along its axis. The front end portion 21 has two slots 5 formed, in parallel with each other symmetrically with respect to the axis thereof, on a front face thereof. The body portion 22 is constituted by a front body portion 22*a* having a diameter smaller than that of the front end portion 21, an intermediate body portion 22*b* having a diameter slightly larger than that of the front body portion 22*a*, and a rear body portion 22*c* having a diameter larger than that of the intermediate body portion 22*b*. The front body portion 22*a* is formed with two delivery holes 6 extending radially in alignment with each other and communicating with the flow path 4. The intermediate body portion 22*b* is formed with a circumferential groove 8 such that an O-ring 7 acting as a sealing member is fitted around the circumferential groove 8. The rear body portion 22*c* has an external thread portion 9 formed on an outer periphery thereof such that an internal thread portion 15 of the cap member 3 is engaged with the external thread portion 9. The cap member 3 is mounted on the nozzle body 2 through engagement of the internal thread portion 15 with the external thread portion 9. Meanwhile, the connector portion 23 having a diameter larger than that of the body portion 22 is formed with an internal thread portion 24 such that a pipe 11 extending from the sprayer 17 is connected with the nozzle body 2 through engagement of the internal thread portion 24 with an external thread portion 25 of the pipe 11. The flow path 4 of the nozzle body 2 is communicated, via the pipe 11, with a spray body 35 of the sprayer 17. It can also be arranged, needless to say, that in the case where the sprayer 17 is too heavy to be portable, a long hose is employed in place of the pipe 11 so as to connect the nozzle body 2 with the nozzle body 35 such that the nozzle K1 can be manipulated without the need for carrying the sprayer 17. The connector portion 23 further has a knurled portion 12 formed on an outer periphery thereof.

Meanwhile, the cap member 3 is of a substantially cylindrical shape and is constituted by a front portion 31 and a rear portion 32 having a diameter slightly larger than that of the front portion 31. The front portion 31 has a conically projecting front end at a center of which a spray opening 13 is formed. The front portion 31 further has a plurality of discharge openings 14 formed at circumferential intervals on a rear outer peripheral portion thereof, each having a diameter slightly larger than that of the spray opening 13. The cap member 3 is formed with a central bore 18 communicating with the spray opening 13 and the discharge openings 14. The internal thread portion 15 is formed in the central bore 18. When an operator rotates the cap member 3 in threaded engagement with the nozzle body 2, the cap member 3 is axially moved, either forward or rearward relative to the nozzle body 2. A plurality of elongated non-slip notches 16 are formed at circumferential intervals on the outer periphery of the rear portion 32 so as to extend in an axial direction of the cap member 3.

As shown in FIG. *2a*, when the cap member 3 has been fully screwed onto the nozzle body 2, the discharge openings 14 of the cap member 3 are disposed axially rearward of the O-ring 7 of the nozzle body 2, so that chemical liquid drawn to the flow path 4 from the sprayer 17 is sprayed from the spray opening 13 via the delivery holes 6 and the slots 5 and thus, the nozzle K1 is in a spray mode. Meanwhile, when the cap member 3 has been moved axially forward relative to the nozzle body 2 by rotating the cap member 3 until the discharge openings 14 are disposed axially forward of the O-ring 7 as shown in FIG. *2b*, the chemical liquid fed to the flow path 4 from the sprayer 17 is showered from the discharge openings 14 and thus, the nozzle K1 is in a shower mode.

FIG. *3a* illustrates an operation of the sprayer 17 provided with the nozzle K1 in the spray mode of FIG. *2a*. In FIG. *3a*, disinfectant employed as the chemical liquid is sprayed over a potted plant 20 by the nozzle K1. The sprayer 17 includes the spray body 35 and a supply tank 36 for containing the chemical liquid. A pump (not shown) is provided in the spray body 35 and the spray body 35 and the supply tank 36 are coupled with each other. In the case where a switch button 37 for actuating the pump in the spray body 35 is manipulated when the nozzle K1 is in the spray mode, namely the cap member 3 has been fully screwed onto the nozzle body 2 as shown in FIG. *2a*, the disinfectant is sprayed from the spray opening 13.

On the other hand, FIG. *3b* illustrates another operation of the nozzle K1 in the shower mode of FIG. *2b*. In FIG. *3b*, fertilizer employed as the chemical liquid is showered on soil of the potted plant 20. In the case where the switch button 37 is manipulated when the nozzle K1 is in the shower mode, namely the cap member 3 has been moved axially forward relative to the nozzle body 2 until the discharge openings 14 are disposed axially forward of the O-ring 8 as shown in FIG. *2b*, the fertilizer is showered from the discharge openings 14.

Thus, in the nozzle K1, by moving the cap member 3 relative to the nozzle body 2 axially rearward or forward through rotation of the cap member 3, the nozzle K1 can be easily changed from the spray mode for spraying the chemical liquid from the spray opening 13 to the shower mode for showering the chemical liquid from the discharge openings 14, respectively.

As is clear from the foregoing description, the nozzle K1 for the sprayer 17 is constituted by the nozzle body 2 communicating with the spray body 35 of the sprayer 17 and the cap member 3 which is axially retractably mounted on the nozzle body 2. The nozzle body 2 is formed with the delivery holes 6 and the sealing member 7 is fitted around the nozzle body 2 axially rearward of the delivery holes 6. Furthermore, the spray opening 13 is formed on the front face of the cap member 3 and the discharge openings 14 are formed on the outer periphery of the front portion 31 of the cap member 3.

Thus, in accordance with the first embodiment of the present invention, the nozzle can be easily changed over between the spray mode and the shower mode by rotating the cap member 3 in threaded engagement with the nozzle body 2.

Referring now to FIGS. 4 to 8, there is shown a nozzle K2 according to a second embodiment of the present invention. The nozzle K2 includes the nozzle body 2, the cap member 3 and a cover 40 mounted on the cap member 3. It is to be noted that the changeover stroke of the cap member 3 of the nozzle K2 between a spray mode and a shower mode is decreased as compared with that of the nozzle K1. Furthermore, in the nozzle K1, the discharge openings 14 of the cap member 3 are passed in sliding contact with the sealing member 7 during the changeover operations of the nozzle K1 with a consequent possibility that the sealing member 7 may be damaged by the edges of the discharge holes 14. However, in the nozzle K2, since it is arranged that the discharge openings 14 are disposed above the sealing member 7 even when the cap member 3 has been moved axially to the rearward limit of the changeover stroke of the cap member 3, it becomes possible to positively prevent the sealing member 7 from being damaged by the edges of the discharge holes 14 during the changeover operation of the nozzle K2. As shown in FIG. *7a*, the circumferential groove 8 of the cap member 2 is formed so as to have a width slightly larger by a distance d than the thickness of the O-ring 7 such that the O-ring 7 is allowed to slide slightly axially in the circumferential groove 8.

Meanwhile, one set of three discharge holes 14 and another set of three discharge holes 14 each having a rectangular shape are formed on the rear outer peripheral portion of the front portion 31 of the cap member 3 so as to be circumferentially spaced from each other such that one set of the three discharge holes 14 radially confront another set of the three discharge holes 14. It can be also so arranged that the circular discharge holes 14 of the nozzle K1 are formed at a circumferential interval on the outer periphery of the front body 31 in place of the above described rectangular discharge holes 14. The cap member 3 of the nozzle K2 is not formed with the non-slip notches 16 of the nozzle K1.

The cover 40 is of a substantially cylindrical shape and is made of elastic synthetic resin. The cover 40 has a conically projecting front end at a center of which an outlet hole 27 is formed. When the cover 40 is mounted on the front portion 31 of the cap member 3, a passageway 19 is defined between the front portion 31 and the cover 40. A plurality of elongated ribs 42 are formed on an inner periphery of the cover 40 so as to coaxially extend in an axial direction of the cover 40. The ribs 42 are arranged to reinforce the cover 40 and define the passageway 19 such that the chemical liquid in the passageway 19 is guided in the axial direction of the cover 40 by the ribs 42. An annular groove 43 is formed on the inner periphery of the cover 40. When the annular groove 43 is elastically fitted around an annular projection 3*a* of the cap member 3, the cover 40 is mounted on the cap member 3 such that the passageway 19 is sealed through elastic engagement of the annular groove 43 with the annular projection 3*a*. Furthermore, a plurality of elongated non-slip notches 41 are formed at circumferential intervals on an outer periphery of the cover 40 so as to extend in the axial direction of the cover 40. Since other constructions of the nozzle K2 are similar to those of the nozzle K1, detailed description thereof is abbreviated for the sake of brevity.

Figure 6A:
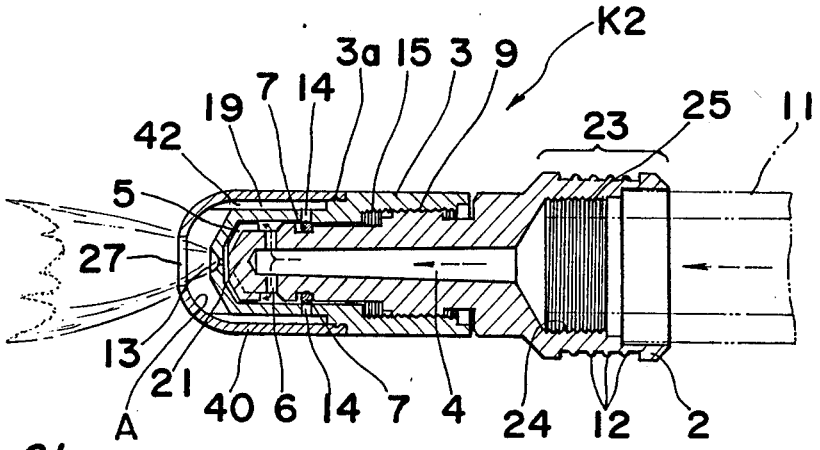
FIGS. 6*a*, 6*b* and 6*c* are longitudinal sectional views of the nozzle of FIG. 4, showing the nozzle in a spray mode, a spouting mode and a shower mode, respectively.

As shown in FIG. 6*a*, when the cap member 3 has been fully screwed onto the nozzle body 2 by rotating the cover 40 mounted on the cap member 3, the discharge openings 14 of the cap member 3 are disposed above the O-ring 7 such that the discharge openings 14 are closed by the O-ring 7 as specifically shown in FIGS. 7*a* and 7*b*, so that the chemical liquid conveyed by the flow path 4 is sprayed, through the delivery holes 6 and the slots 5, from the spray opening 13 of the nozzle body 2 and the outlet hole 27 of the cover 40 and thus, the nozzle K2 is in the spray mode. At this time, since the discharge openings 14 have a rectangular shape each, the O-ring 7 is securely brought into close contact with the discharge openings 14 so as to completely seal the discharge openings 14. Meanwhile, as shown in FIG. 6*c*, when the cap member 3 has been moved axially forward relative to the nozzle body 2 by rotating the cap member 3 through the cover 40 until the discharge openings 14 are disposed axially forward of the O-ring 7, the chemical liquid carried by the flow path 4 is drawn from the discharge openings 14 to the passageway 19 and then showered, for watering, from the outlet hole 27, so that the nozzle K2 is in the shower mode. Furthermore, as shown in FIG. 6*b*, when the cap member 3 is disposed at a position relative to the nozzle body 2 between that corresponding to the spray mode (FIG. 6*a*) and that corresponding to the shower mode (FIG. 6*c*), the O-ring 7 is allowed to be moved over the distance d (FIG. 7*a*) in the circumferential groove 8 so that the discharge openings 14 remain sealed, so that the chemical liquid is spouted from the outlet hole 27 via the delivery holes 6 and the spray opening 13 and thus, the nozzle K2 is in a spouting mode.

As shown in FIG. 6*a*, when the cap member 3 is disposed at a rearward limit of the changeover stroke of the cap member 3 between the spray mode and the shower mode, namely the nozzle K2 is in the spray mode, a rear face of the cap member 3 comes into contact with a front face of the connector portion 23 of the nozzle body 2. At this time, the discharge openings 14 are disposed above the O-ring 7 so as to be completely closed by the O-ring 7. At this rearward limit of the changeover stroke of the cap member 3, the O-ring 7 made of soft material is elastically and securely brought into close contact with the discharge openings 14 so as to positively seal the discharge openings 14 as shown in FIGS. 7*a* and 7*b*. Moreover, in the nozzle K2, since the changeover stroke of the cap member 3 between the spray mode and the shower mode is decreased as compared with that of the nozzle K1, the nozzle K2 can be easily changed over to the spray mode and the shower mode. Furthermore, since the discharge holes 14 are not passed, in sliding contact with the O-ring 7, over the O-ring 7 during the changeover operations of the nozzle K2, it becomes possible to positively prevent the O-ring from being damaged by the edges of the discharge holes 14 during the changeover operations of the nozzle K2. In addition, since the circumferential groove 8 has the width slightly larger than the thickness of the O-ring 7 by the distance d, the O-ring 7 is prevented from rapidly coming into contact with the edges of the discharge openings 14 during the changeover operations of the nozzle K2 as shown by the chain lines in FIG. 7*a*, so that it becomes possible to prevent a large stress leading to damage of the O-ring 7 from being applied to the O-ring 7. The distance d acts as a play for the changeover operations of the nozzle K2 between the spray mode and the shower mode such that the changeover operations of the nozzle K2 between the spray mode and the shower mode can be performed when the discharge openings 14 are closed by the O-ring 7, as shown in FIG. 6*b*.

Figure 6B:
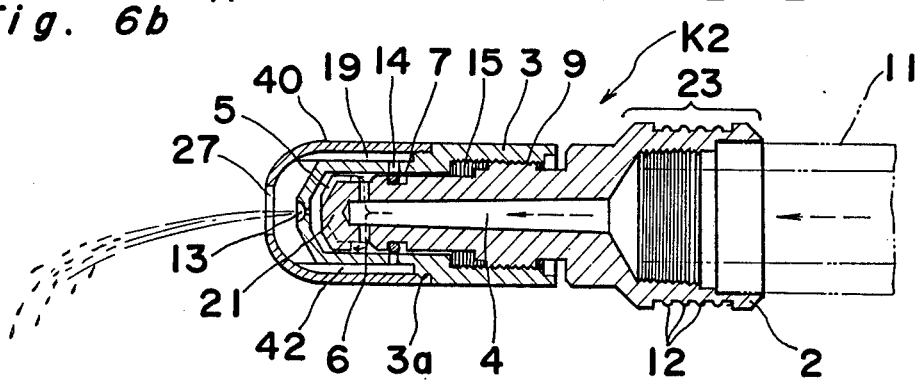
Figure 6C:
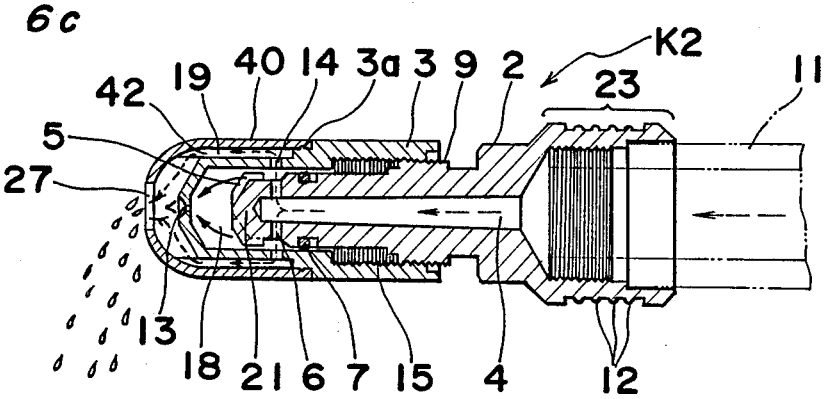
Figure 8A:
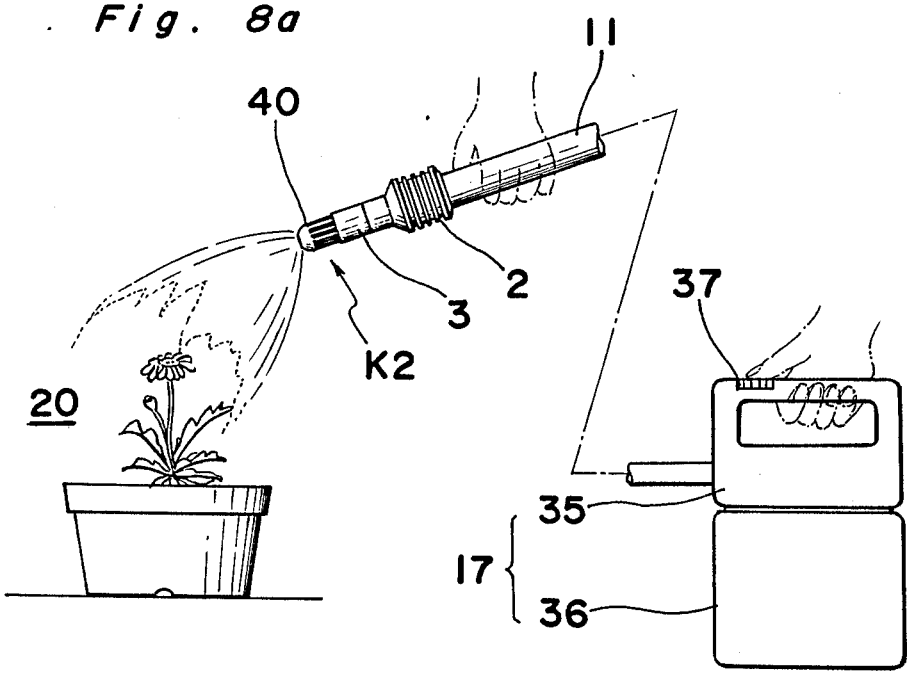
FIGS. 8*a*, 8*b* and 8*c* are side elevational views of the nozzle of FIG. 4, showing operations of the nozzle in the spray mode, the spouting mode and the shower mode, respectively.
Figure 8B:
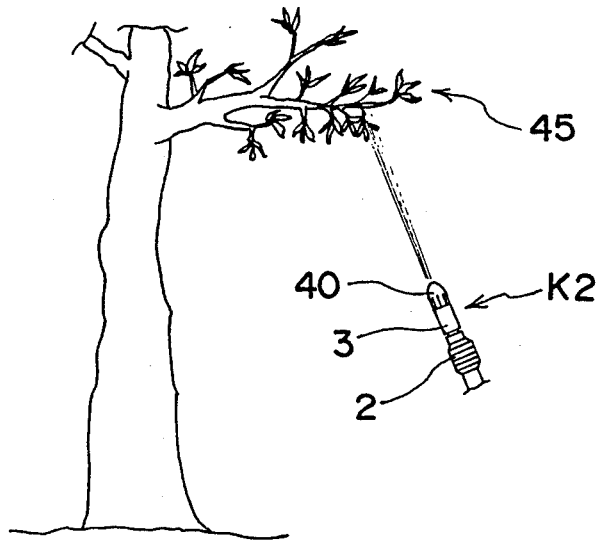
Figure 8C:
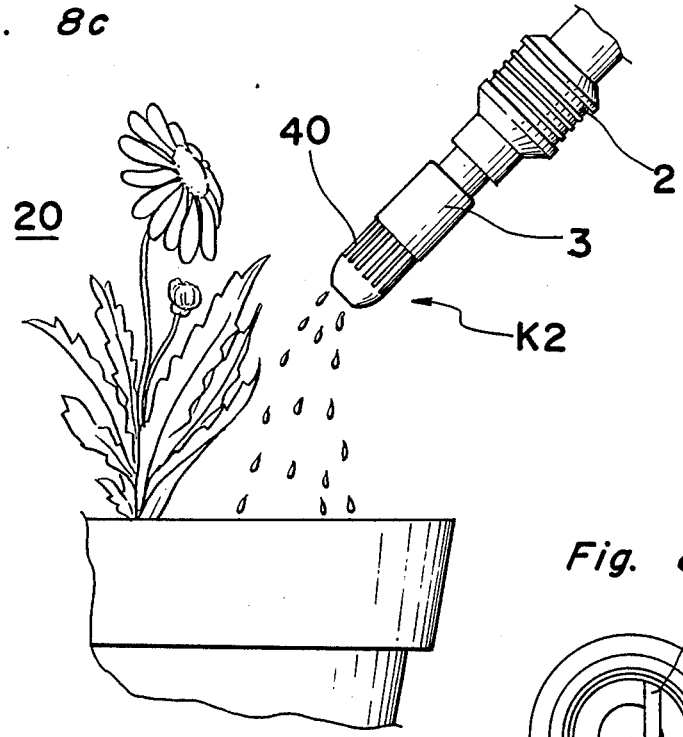
Figure 8D:
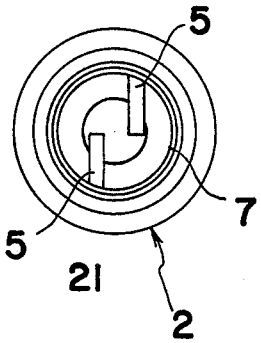
FIG. 8*d* is a front end view of the nozzle body.

FIGS. 8*a*, 8*b* and 8*c* illustrate operations of the sprayer 17 provided with the nozzle K2 in the spray mode of FIG. 6*a*, the spouting mode of FIG. 6*b* and the shower mode of FIG. 6*c*, respectively. In the case where the switch button 37 for actuating the pump in the spray body 35 is manipulated when the nozzle K2 is in the spray mode as shown in FIG. 8*a*, disinfectant employed as the chemical liquid is passed through the delivery holes 6 from the flow path 4 and then, is sprayed over the potted plant 20 from the outlet hole 27 via the spray opening 13. When the nozzle K2 is in the spouting mode as shown in FIG. 8*b*, its discharge pressure becomes larger than those in the spray mode and the shower mode so as to enable the chemical liquid to be discharged further than in the spray mode and the shower mode and thus, fertilizer or water is vigorously spouted far, for example, on a high branch 45 of a tall tree from the outlet hole 27 via the spray opening 13. Furthermore, when the nozzle K2 is in the shower mode as shown in FIG. 8*c*, the fertilizer or water is passed from the flow path 4 to the discharge openings 14 through the delivery holes 6 and then, is showered on a restricted necessary area of the soil of the potted plant 20 from the outlet hole 27 via the passageway 19.

Thus, in the nozzle K2, by moving the cap member 3 relative to the nozzle body 2 axially rearward and forward through rotation of the cap member 3, the nozzle K2 can be easily changed over to the spray mode for spraying the chemical liquid, the spouting mode for spouting the chemical liquid and the shower mode for showering the chemical liquid.

Furthermore, as shown in FIGS. 6*a* to 6*c*, since a front end portion of the cover 40 is disposed axially forward of that of the cap member 3, drops of the chemical liquid adhering to an outer periphery of the front end portion of the cap member 3 after completion of operation of the sprayer 17 are received by an inner periphery A of the front end portion of the cover 40 so as prevent dripping and further, the cap member 3 vulnerable to external forces, especially its front end portions, is protected by the cover 40.

Figure 9:
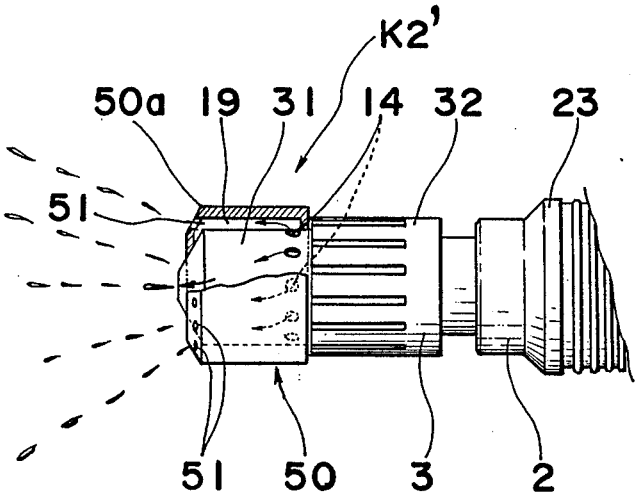
FIG. 9 is a view similar to FIG. 8*c*, particularly showing a modification thereof.

Referring further to FIG. 9, there is shown a nozzle K2' which is a modification of the nozzle K2. The modified nozzle K2' includes a cover 50 in place of the cover 40 of the nozzle K2. The cover 50 has an inclined front edge 50*a* formed, and at the inclined front edge 50*a* a plurality of apertures 51 are formed. When the modified nozzle K2' is in the shower mode, the chemical liquid is passed through the passageway 19 from the discharge openings 14 so as to be showered from the apertures 51.

As is clear from the foregoing description, the nozzle K2 for the sprayer 17 is constituted by the nozzle body 2 communicating with the spray body 35 of the sprayer 17, the cap member 3 axially retractably mounted on the nozzle body 2 and the cover 40 mounted on the cap member 3. The nozzle body 2 has the flow path 4 formed at its central portion and is formed with the delivery holes 6 communicating outside with the flow path 4. Meanwhile, the annular sealing member 7 made of soft material is fitted around the nozzle body 2 axially rearward of the delivery holes 6. Furthermore, the spray opening 13 is formed on the front face of the cap member 3 and the discharge openings 14 are formed on the outer periphery of the front portion 31 of the cap member 3.

Thus, in accordance with the second embodiment of the present invention, since it is so arranged that the discharge openings 14 are disposed above the sealing member 7 when the nozzle K2 is in the spray mode, i.e., the cap member 3 is disposed at the rearward limit of the changeover stroke of the cap member 3 between the spray mode and the shower mode, the changeover operations of the nozzle K2 between the spray mode and the shower mode can be easily performed on the basis of the reduced changeover stroke of the cap member 3 through rotation of the cap member 3.

Furthermore, in accordance with the second embodiment of the present invention, when the nozzle K2 is in the spray mode, the discharge holes 14 are positively sealed by the sealing member 7, so that unnecessary leakage of the chemical liquid from the nozzle K2 does not take place and thus, a sufficient internal pressure is produced in the nozzle K2.

Moreover, in accordance with the second embodiment of the present invention, the sealing member 7 is not damaged by the edges of the discharge openings 14 during the changeover operations of the nozzle K2 between the spray mode and the shower mode.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A nozzle device for connection with a pump means, comprising:

a nozzle body having formed therein at least one delivery hole communicating via a flow path extending axially along an axis thereof with said pump means such that liquid is fed to said at least one delivery hole by said pump means;

a sealing member fitted around said nozzle body axially rearward of said at least one delivery hole;

a cap member having front and rear portions, formed around a central axis and being axially movably mounted on said nozzle body, said cap member having a spray opening, including said central axis, formed at a front face of said front portion and a plurality of discharge openings formed through an outer periphery of said front portion, said cap member being movable in axially rearward and forward directions relative to said nozzle body to a plurality of positions, in said plurality of positions supply of liquid from said at least one delivery hole to said discharge openings in either blocked or not blocked by said sealing member; and a cover member formed around said central axis and mounted on said front portion of the cap member, said cover member having an outlet hole including said central axis, said outlet hole being in alignment with and axially forward of said spray opening so as to confront and communicate with said spray opening, and a passageway for the flow of liquid from said at least one delivery hole through said plurality of discharge openings to said outlet hole defined between the inner periphery of the cover member and the outer periphery of the cap member such that said nozzle device provides three distinct modes of delivery of said liquid.

2. A nozzle device as in claim 1, wherein said cap member has an annular projection formed on said outer periphery thereof, and said cover member is provided with an annular groove on an inner periphery thereof, such that said cover member is mounted on said cap member through elastic engagement of said annular groove of said cover member with said annular projection of said cap member.

3. A nozzle device for connection with a pump means, comprising:

a nozzle body having formed therein at least one delivery hole communicating via a flow path extending axially along an axis thereof with said pump means such that liquid is fed to said at least one delivery hole by said pump means;

a sealing member fitted around said nozzle body axially rearward of said at least one delivery hole;

a cap member having front and rear portions and being axially movably mounted on said nozzle body, said cap member having a spray opening formed at a front face of said front portion and a plurality of discharge openings formed through an outer periphery of said front portion, said cap member being movable in axially rearward and forward directions relative to said nozzle body to a plurality of positions, in said plurality of positions supply of liquid from said at least one delivery hole to said discharge openings is either blocked or not blocked by said sealing member;

a cover member mounted on said front portion of the cap member, said cover member having an outlet hole, said outlet hole being in alignment with and axially forward of said spray opening so as to confront and communicate with said spray opening, and a passageway for the flow of liquid from said at least one delivery hole through said plurality of discharge openings to said outlet hole defined between the inner periphery of the cover member and the outer periphery of the cap member such that said nozzle device provides three distinct modes of delivery of said liquid; and further including a plurality of ribs formed extending in an axial direction on an inner periphery of said cover member defining said passageway.

4. A nozzle device for connection with a pump means, comprising:

a nozzle body having formed therein at least one delivery hole communicating via a flow path extending axially along an axis thereof with said pump means such that liquid is fed to said at least one delivery hole by said pump means;

a sealing member fitted around said nozzle body axially rearward of said at least one delivery hole;

a cap member having front and rear portions and being axially movably mounted on said nozzle body, said cap member having a spray opening formed at a front face of said front portion and a plurality of discharge openings formed through an outer periphery of said front portion, said cap member being movable in axially rearward and forward directions relative to said nozzle body to a plurality of positions, in said plurality of positions supply of liquid from said at least one delivery hole to said discharge openings is either blocked or not blocked by said sealing member;

a cover member mounted on said front portion of the cap member, said cover member having an outlet hole, said outlet hole being in alignment with and axially forward of said spray opening so as to confront and communicate with said spray opening, and a passageway for the flow of liquid from said at least one delivery hole through said plurality of discharge openings to said outlet hole defined between the inner periphery of the cover member and the outer periphery of the cap member such that said nozzle device provides three distinct modes of delivery of said liquid; and said nozzle body comprises a front end portion, a body portion and a rear connector portion, said body portion consisting of a front body portion, an intermediate body portion and a rear body portion, said front body portion having a diameter smaller than that of said front end portion, said intermediate body portion having a diameter larger than that of said front body portion and said rear body portion having a diameter larger than that of said intermediate body portion, said intermediate body portion having formed on the surface thereof a circumferential groove in which said sealing member is fitted, said circumferential groove having a width which accommodates said sealing member and allows said sealing member to be moved axially relative to said body portion a predetermined distance when said cap member is moved said predetermined distance to provide a space between the front face of said cap member and the front end portion of said nozzle body, the plurality of discharge openings being directly closed by said sealing member over said predetermined distance, such that by axially moving said cap member relative to said nozzle body said distance between the front face of the cap member and front end portion of the nozzle body, said nozzle device is changed over from a spray mode for spraying liquid to a spouting mode for spouting liquid.

5. The nozzle device of claim 4, wherein said at least one delivery hole is located in said front body portion of said nozzle body and includes two delivery holes extending radially in alignment with each other and communicating with said flow path.

6. The nozzle device of claim 5, wherein said front end portion of said nozzle body has two slots formed therein parallel with each other symmetrical with respect to the axis thereof which communicate with said delivery holes of said front body portion.

7. The nozzle device of claim 4, wherein said rear body portion of said nozzle body has an external thread portion formed on an outer periphery thereof such that an internal thread portion of said cap member engages said external thread portion of said rear body portion when said cap member is mounted on said nozzle body.

* * * * *